United States Patent [19]

Taylor

[11] 4,133,266

[45] Jan. 9, 1979

[54] RAILROAD CROSSTIE REPLACEMENT MACHINE

[76] Inventor: Glenn E. Taylor, 1345 Bankhead Ave., Atlanta, Ga. 30318

[21] Appl. No.: 780,716

[22] Filed: Mar. 24, 1977

[51] Int. Cl.[2] ..... E01B 29/10

[52] U.S. Cl. ..... 104/9; 37/104; 104/6

[58] Field of Search ..... 104/2, 9, 6; 37/104–106

[56] References Cited

U.S. PATENT DOCUMENTS

| | | | |
|---|---|---|---|
| 3,314,374 | 4/1967 | Moorehead et al. | 104/9 |
| 3,537,400 | 11/1970 | Taylor | 104/9 |
| 3,780,664 | 12/1973 | Holley et al. | 104/9 |
| 3,881,422 | 5/1975 | Bryan | 104/9 |

FOREIGN PATENT DOCUMENTS

| | | | |
|---|---|---|---|
| 970221 | 7/1975 | Canada | 104/9 |

OTHER PUBLICATIONS

Kershaw Manu. Inc. Advertisement dated Feb. 1975.

Railway Track and Structures, pp. 32 and 33, dated Jun. 1976.

Kershaw Manu. Inc. Advertisement dated Aug. 1976.

*Primary Examiner*—Albert J. Makay

*Assistant Examiner*—Carl Rowold

*Attorney, Agent, or Firm*—Jones, Thomas & Askew

[57] ABSTRACT

New railroad crossties are placed on the rails of a railroad track and pushed along the track by a rail mounted vehicle. When the new crosstie is positioned over a crosstie in the railroad bed that it to be replaced, the ballast at one end of the old crosstie is removed, the rails are urged upwardly to relieve the force on the old crosstie, the new crosstie is then grasped and moved along its length laterally across the track until its trailing end clears the exposed end of the old crosstie, then the new crosstie is lowered and pushed against the exposed end of the old crosstie until the new crosstie pushes the old crosstie out from beneath the rails. A work head assembly is mounted at one end of the vehicle and includes a shovel and clamp assembly, and the work head assembly is movable laterally with respect to the rails of the railroad track to clear the soil away from the ends of the old crossties and to grasp and insert the new crossties beneath the rails.

4 Claims, 13 Drawing Figures

RAILROAD CROSSTIE REPLACEMENT MACHINE

BACKGROUND OF THE INVENTION

When the crossties of a railroad are to be replaced, selected ones of the crossties are individually replaced without removing the rails from the railroad. Usually, the tie plates that hold the rails on the crossties are removed from an old crosstie, the rails urged in an upward direction to relieve the downward force on the old crosstie, and then the old crosstie is pushed or pulled laterally from beneath the rails. A new replacement crosstie can then be inserted in the space vacated by the old removed crosstie.

As illustrated in my U.S. Pat. No. 3,537,400, rail mounted vehicles have been developed for removing old crossties from railroad beds. The vehicle has a crosstie kicker on one of its sides which functions to urge or "kick" a crosstie laterally beneath the tracks, while at the other side of the vehicle a clamp mechanism grasps the protruding end of a partially removed crosstie and pulls the crosstie on out from beneath the rails.

While the prior art illustrates various means for ejecting old crossties from railroad beds, there is still a need for effective equipment that will not only eject old crossties from a railroad bed but will also expediently insert new crossties in the space vacated by an old crosstie.

SUMMARY OF THE INVENTION

Briefly described, the present invention comprises a crosstie replacement system for removing old crossties and inserting new crossties in a railroad. New or replacement crossties are distributed on top of the rails of a railroad track at locations where old crossties are to be removed. A railroad track mounted vehicle then moves along the track and pushes a new crosstie along the track until it is placed over and parallel to a crosstie that is to be removed from the bed. The rails are grasped by rail dogs suspended from the vehicle and the front end of the vehicle is raised by jacks carried on the vehicle to urge the rails upwardly away from the crossties and to relieve the downward force from the rails against the old crosstie. A work head on one side of the vehicle includes a shovel and a clamp assembly, and the shovel assembly functions to clear the soil or ballast away from one end of the old crosstie. The new crosstie is then grasped by the clamp assembly, moved along its length laterally with respect to the rails of the railroad track until its trailing end clears the exposed end of the old crosstie, the new crosstie is then lowered until it is at the level of the old crosstie, and then the new crosstie is forced back beneath the rails so that it pushes the old crosstie out from beneath the rails and occupies the space vacated by the old crosstie.

The clamp assembly and shovel are mounted on a housing at the front of the vehicle and a crosstie pusher or "kicker" is mounted in the other end of the housing. The crosstie kicker functions to push the crossties along their lengths laterally with respect to the rails of the track as the machine is manipulated in the crosstie replacement steps. The vehicle includes means for turning the support housing around so as to reverse the positions of the crosstie kicker with respect to the shovel and clamp assemblies, so that the crossties can be ejected and inserted in either direction.

Thus, it is an object of this invention to provide a crosstie replacement system which functions to both eject old crossties and insert new crossties in a railroad bed.

Another object of this invention is to provide apparatus for expediently and economically replacing crossties in a railroad bed.

Another object of this invention is to provide a method of replacing old crossties with new crossties in a railroad bed, which includes the step of pushing with a new crosstie against the old crosstie in a railroad bed to simultaneously force the old crosstie out from beneath the rails while inserting a new crosstie beneath the rails.

Other objects, features and advantages of the invention will become apparent upon reading the following specification, when taken in conjunction with the accompanying drawing.

DETAILED DESCRIPTION

Figure 1:
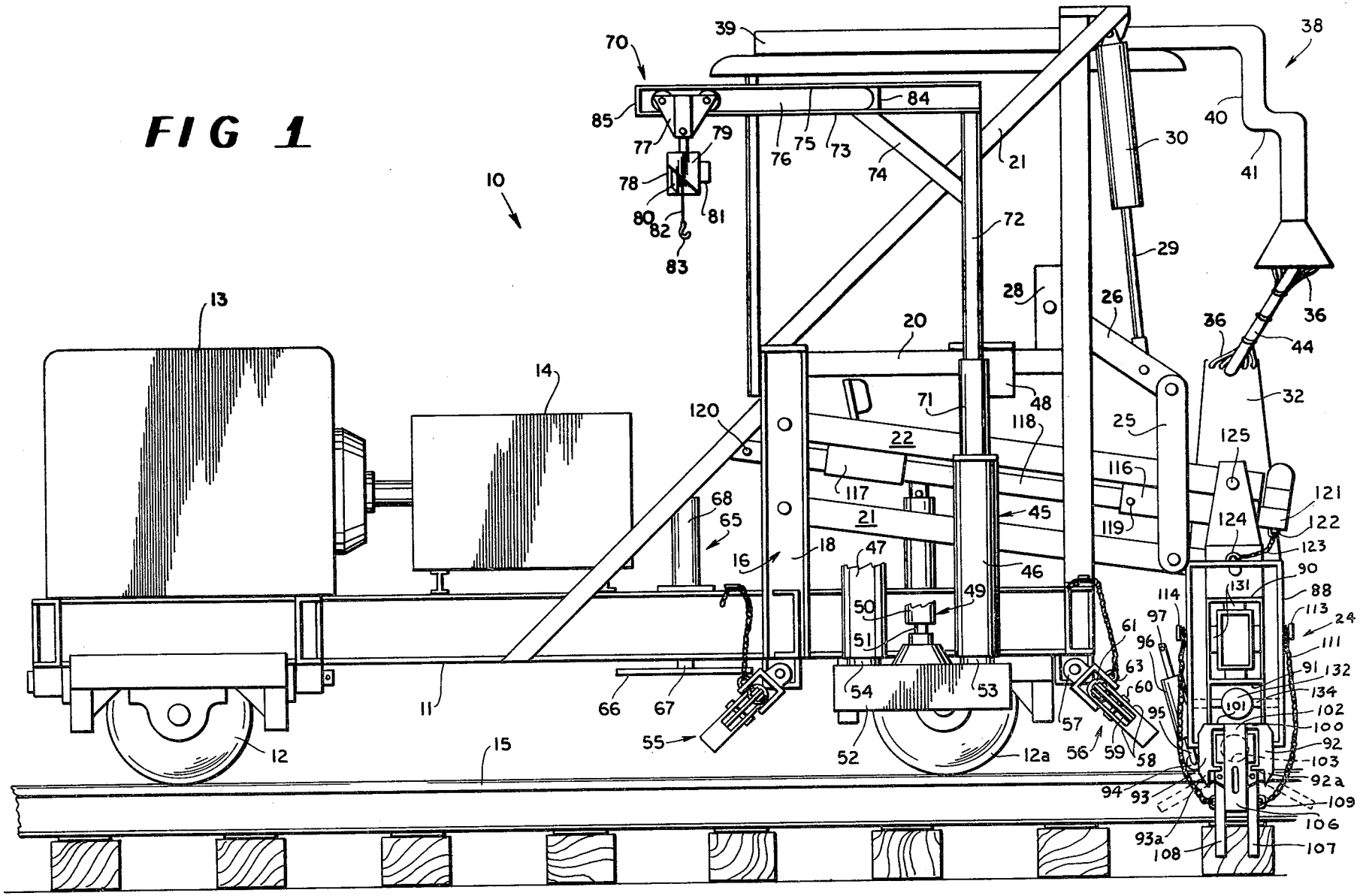
FIG. 1 is a side elevational view of a crosstie replacement vehicle which is in the form of a vehicle movable along the rails of a conventional railroad track.

Referring now in more detail to the drawing, in which like numerals indicate like parts throughout the several views, FIG. 1 illustrates the crosstie replacement vehicle 10 which includes a base framework 11 mounted on railroad wheels 12. Diesel engine 13 is located over the rear wheels of the vehicle, and the engine 13 operates pump assembly 14. The liquid from pump assembly 14 is used to power the various components of the vehicle and to drive the vehicle along the railroad track 15. The several storage tanks for storing the hydraulic liquid and diesel fuel, the hydraulic conduits, counterweights and other conventional components of a system of this type are not illustrated in the drawings.

Upwardly extending framework 16 is mounted on the base framework 11 and includes a pair of upright supports 18 mounted at each side of the base framework 11 behind the forward wheels **12*a* of the vehicle, a second pair of upright support elements 19 mounted at the forward end of the vehicle in front of the forward wheels 12*a*, horizontal brace 20 and inclined brace 21 connected between the upright pairs of supports 18 and 19. Pairs of parallel arms 21 and 22 are each connected at one of their ends to the pairs of upright supports 18. The pairs of parallel support arms 21 and 22 are connected at their other ends to housing 24. A pair of lifting links 25 are connected at their lower ends to the lower pair of parallel support arms 21** and at their upper ends to pivoting links 26. Pivoting links 26 are pivotally connected to framework support blocks 28. A pair of hydraulic rams 29 each have their cylinders 30 connected to the upstanding framework 16, and their ramrods 31 are connected to the pivoting links 26. With this arrangement, the movement of the ramrod 31 of the ram 29 lifts and lowers the pairs of parallel support arms 21 and 22 and the housing 24 at the front of the vehicle, and the parallel linkage of the pairs of parallel support arms 21 and 22 will maintain the housing 24 in the attitude illustrated.

A work head assembly 32 is mounted on one end of housing 24 and a crosstie kicker assembly 35 is mounted on the other end of the housing 24. Both the work head assembly and crosstie kicker assembly require fluid pressure for actuating their respective components, and a plurality of fluid conduits 36 communicate with the work head and with the housing 24. Since the work head 32 is movable (described in more detail hereinafter), the conduits 36 must be movable with the work head. Boom 38 is pivotally mounted at its end 39 to the upper portion of the upstanding framework 16 and projects forwardly over the upper portion of the vehicle, and turns downwardly at 40 in front of the vehicle, then forwardly again at 41 and then downwardly again at 42. The plurality of fluid conduits 36 extend through boom 38. Crossbar 44 is connected at one of its ends to the lower end of boom 38 and at the other of its ends to work head assembly 32. The plurality of fluid conduits 36 are supported by crossbar 44 as they extend from the lower end of boom 38 to the work head 32 and function to move the liquids from pumps 14 to the various rams on the work head assembly.

A pair of hydraulic jack assemblies 45 are mounted on the base framework 11 of the vehicle, with each jack assembly 45 being mounted on opposite sides of the vehicle and at the front wheels 12*a* of the vehicle. Jack assemblies include upstanding tubular guides 46 and 47 which are rigidly connected to the base framework 11, cross head 48 rigidly connected at its ends to the upper ends of the tubular guides 46 and 47, hydraulic ram 49 which has its cylinder 50 connected at its base to crossbar 48 and a distendable ramrod 51. Support foot 52 has upwardly extending guide bars 53 and 54 received in the guide tubes 46 and 47, and the ramrod 51 of the ram 49 is connected to the support foot between its guide bars 53 and 54. Thus, when ram 49 is distended or retracted, the support foot 52 will move down into engagement with the bed of the railroad track or upwardly to a retracted, travel position.

Rail dog assemblies 55 are mounted on the base framework 11. A pair of rail dog assemblies 55 are mounted on each side of the framework, with one rail dog assembly positioned in front of the one of the forward wheels 12*a* and the other rail dog assembly positioned behind the forward wheel. Each rail dog assembly includes a hinge connection to the base framework 11, and the hinge pin 57 allows the rail dog to pivot upwardly away from the railroad as illustrated, or downwardly toward engagement with the rails of the railroad. The rail dog assemblies 55 include a pair of clamp elements 58 and 59 which are pivotally connected together with pivot pin 60, which forms downwardly projecting jaws for grasping the ball of a rail. The jaws are shaped (not shown) so that when moved together they form a recess suitable for grasping the ball of a rail. The upper ends of the jaws 58 and 59 are movable toward and away from each other by means of ram 61. Support chain 62 is connected at one of its ends to eye 63 and is connectable to the base framework 11 by inserting one of the chain links over the protrusion such as a bolt. Thus, chain 62 functions to hold the rail dog assemblies 55 up away from the rails when the vehicle is to travel along the railroad track.

Turntable assembly 65 is centrally mounted on the base framework 11 and includes a turntable 66, turntable stem 67, and hydraulic ram 68. The ram 68 causes the turntable 66 to move toward and away from engagement with the railroad bed between the rails of the railroad track, and the turntable 66 is rotatably supported on the framework 11. When the turntable 66 is forced in a downward direction against the bed of the railroad track it lifts the entire vehicle in an upward direction away from the railroad track, and the vehicle can then be turned around to face in the opposite direction.

A pair of side cranes 70 are mounted on the vehicle at opposite sides thereof in the vicinity of the front wheels of the vehicle. Each side crane 70 includes a support sleeve 71 mounted on the exterior surface of the jack guide tube 46 of the jack assembly 45, and upstanding pivotal mast 72 and a laterally extending boom 73. Brace 74 extends between the mast and the boom for support. The boom 73 is fabricated from an eye beam, and the upper and lower flanges 75 and 76 form a track for a boom trolley assembly 77. Winch 78 is suspended from the trolley assembly, and includes a winch housing 79, reel 80, electric motor 81, cable 82 and hook or other connection element 83 at the end of the cable 82. The crane 70 can be pivoted in its tubular support 71 so that its boom 73 projects out to the side or forwardly with respect to the vehicle, and the winch 78 moved along the length of the boom between the inner and outer stops 84 and 85.

Housing 24 at the front of vehicle 10 includes front wall 88, rear wall 89, and inner walls 90 and 91. A plurality of forward and rearward wedge plates 92 and 93 extend downwardly from housing 24 and include beveled wedge surfaces 92*a* and 93*a*. A pair of push bars 94 are mounted on housing 24 and each push bar 94 extends across a rail of the railroad track. Each push bar includes a push bar support stem which extends upwardly from push bar 94, and the stem is telescopically received in a stem housing 96. The stem housings 96 are rigidly connected to the rear wall 89 of the housing 24, and a stop pin 97 extends through the upper end of the stem 95 to keep the push bars from falling out of the sleeves 96.

A pair of inwardly facing channel bars 100 and 101 are connected to the inner surfaces of housing 24 at the lower portion of the housing and extend horizontally across the housing. The channels 100 and 101 form a raceway for trolley 102. Hydraulic ram 103 is supported in the raceway and moves the trolley 102 along the raceway. The kicker assembly 35 is supported at the end of trolley 102 and includes a downwardly extending support 106 connected to the trolley and kicker feet 107 and 108 each pivotally connected at their upper ends to the downwadly extending support 106. Eyes 109 and 110 are connected to the kicker feet 107, and chains 111 and 112 are each connected at one of their ends to an eye 109 and 110 and to a protrusion such as bolts 113 and 114 extending from the front and rear walls 88 and 89 of the housing 24. As illustrated in the dashed lines at the lower portion of the housing 24 in FIG. 1, the kicker feet can be spread apart by applying tension to the chains 111 and 112, so that the kicker feet are retracted upwardly and therefore out of the way of a crosstie.

As shown in FIG. 1, a pair of guide tubes 116 and 117 are mounted on each upper support arm 22 of the pairs of parallel support arms, and a bar 118 is slidably received in tubes 116 and 117. The bar can be maintained in the position illustrated in FIG. 1 by the insertion of a connector pin 119 through aligned openings in tubes 116 and the bars 118, or the bars 118 can be distended through the tubes 116 and 117 until a stop pin 120 engages the rear portion of tubes 117. A crossbar 121 is connected to the outer ends of bars 118, and an eye 122 is connected to the lower portion of crossbar 121. Chain 123 is connected to eye 122, and a similar eye 124 is connected to the upper portion of housing 24. When it is desired to reverse the work head assembly 32 with the crosstie kicker assembly 105, the housing 24 is lowered so that it rests on the rails of the railroad track and the pins 125 and 126 that connect the housing 24 to the pairs of parallel support arms 21 and 22 are removed to disconnect the housing from the vehicle. The connecting pins 119 which extend through tubes 116 and bars 118 are removed so that the bars 118 will slide forwardly with respect to the vehicle. The hyraulic conduits 36 and the crossbar 44 are disconnected from the work head, and the vehicle is then backed away from the housing 24. The bar 118 will slide through the tubes 116 so that the chain 123 will not pull the housing over. When the vehicle is displaced away from the housing 24, the pairs of parallel support arms 21 and 22 are lifted by the ram 29, so that the crossbar 121 and chain 123 lift housing 24 away from the track. A workman can then easily rotate the housing as it is suspended by chain 123 until the positions of the work head assembly and crosstie kicker assembly have been reversed. The housing 24 is then lowered until it rests on the tracks and the vehicle is moved back toward the housing 24 and the housing is then reconnected to the vehicle.

Figure 2:
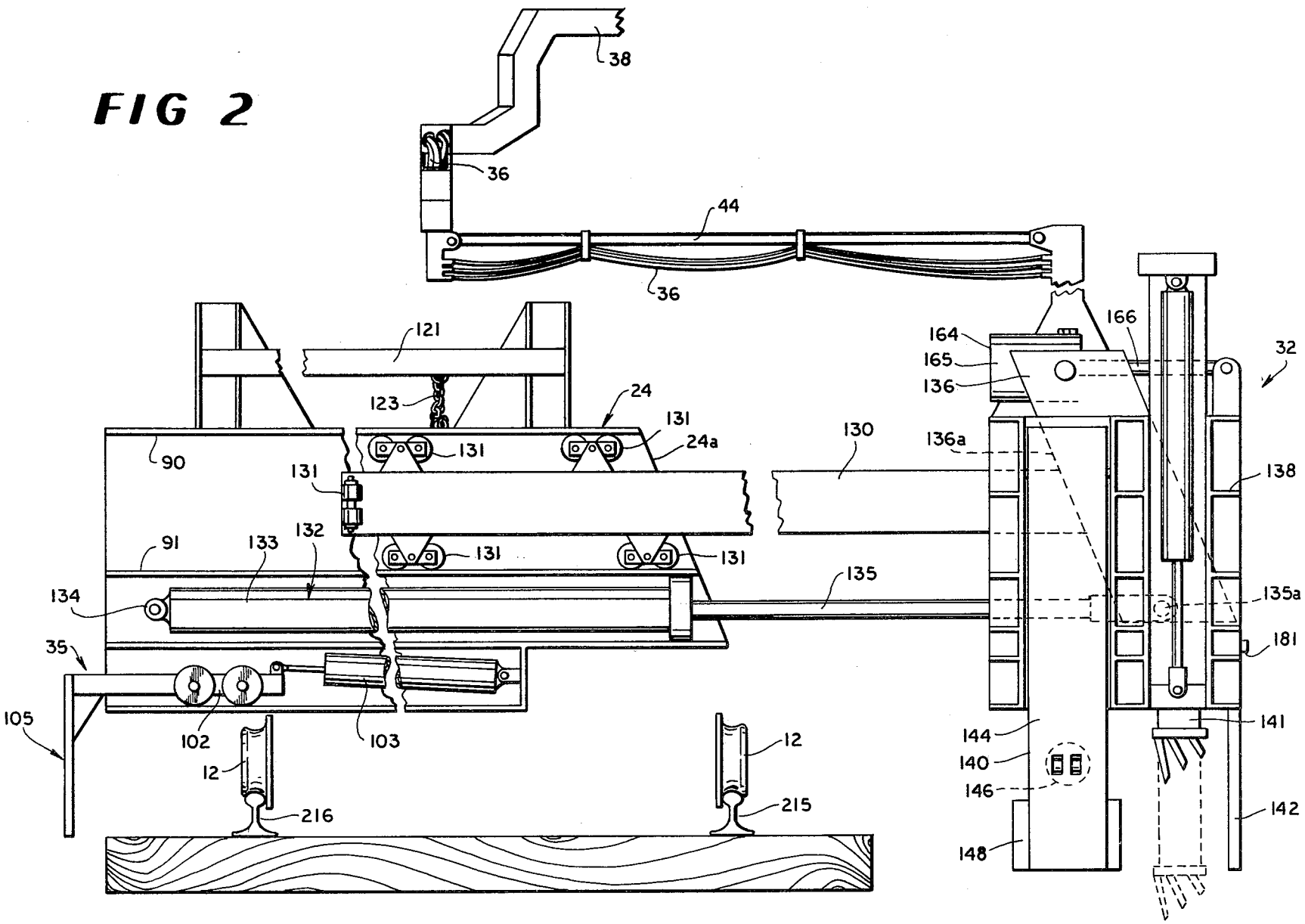
FIG. 2 is a front elevational view of the crosstie replacement vehicle, with parts shown in cross-section and parts removed for clarity.

As illustrated in FIG. 2, the work head assembly 32 is located at one end of the housing 24 while the crosstie kicker assembly 35 is located at the opposite end of the housing, which locates these elements on opposite sides of the railroad track. The work head assembly 32 is mounted on a main boom 130 which is slidably received in the upper portion of housing 24. A plurality of bearings are mounted on the main boom 130 and on the surfaces of housing 24 so as to allow the end portion of the main boom to move into and out of the housing. Hydraulic ram 132 is located in housing 24 beneath main boom 130, and the cylinder 133 of the ram 132 is connected to the housing by crosspin 134, and a ramrod 135 extends from the cylinder 133 toward the cross head assembly 32. Work head assembly support bracket 136 is rigidly connected to the protruding end of main boom 130, and the ramrod 135 is connected to the lower portion of the support bracket 136 and functions to move the support bracket 136 back and forth with respect to housing 24.

Figure 4:
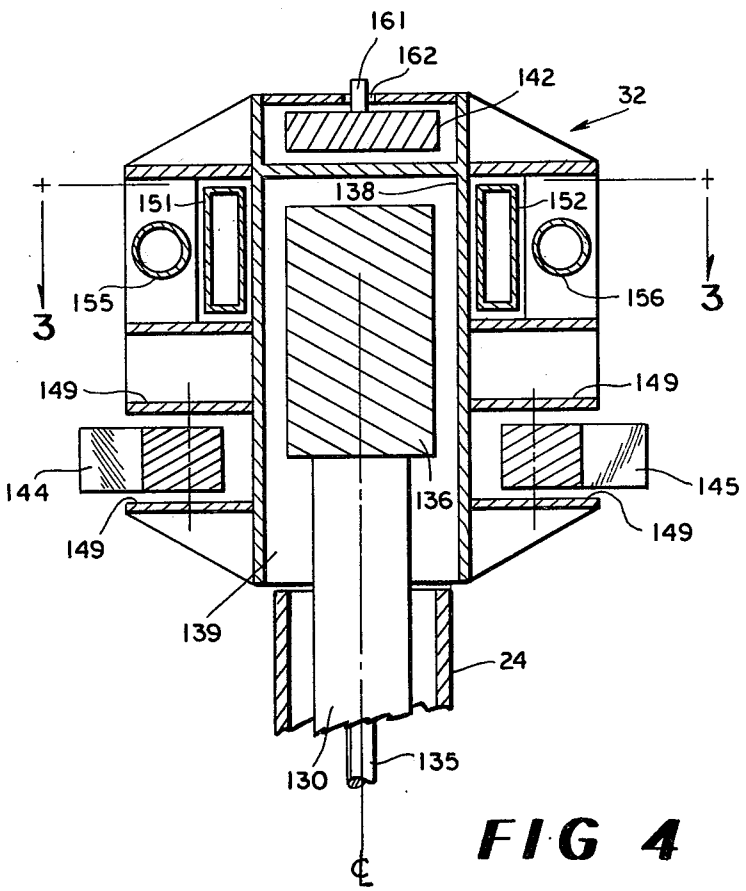
FIG. 4 is a top cross-sectional view, taken along line 4—4 of FIG. 3.

As illustrated in FIG. 4, work head housing 138 surrounds work head support bracket 136 and defines a side opening 139 that faces housing 24. The opening 139 in housing 138 is of a size sufficient to slide over the end of housing 24 so as to close the end of housing 24 when the work head assembly is retracted.

As illustrated in FIG. 2, the work head assembly 32 includes clamp assembly 140, shovel assembly 141, and crosstie push bar 142. The clamp assembly 140 is located adjacent the housing 24 and comprises clamp arms 144 and 145 that are pivotally connected at their upper ends (not shown) to work head assembly housing 138, and hydraulic ram 146 functions to move the lower clamp jaws 148 of each clamp arm 144 and 145 toward and away from each other. Work head assembly housing 138 includes outwardly protruding flanges 149, and the clamp arms 144 and 145 are received between the flanges 149 so that the flanges tend to stabilize and guide the movements of the clamp arms.

Figure 3:
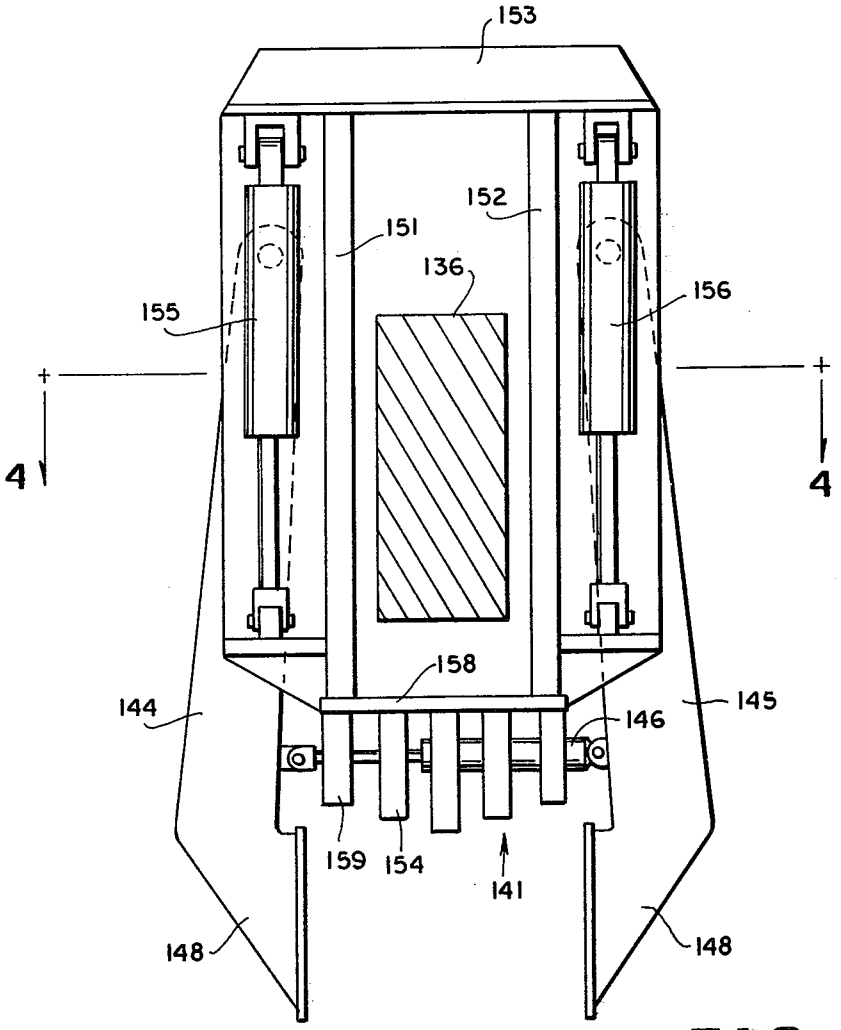
FIG. 3 is an end view of the work head assembly of the vehicle.

Shovel assembly 141 is best illustrated in FIG. 3 and includes a support framework that has upwardly extending framework elements 151 and 152 that are located outside of work head asembly housing 138, crosshead 153 rigidly connected to the upper ends of elements 151 and 152, and shovel 154 rigidly connected to the lower ends of elements 151 and 152. Hydraulic rams 155 and 156 are located on opposite sides of the framework 150 and are each connected to the crosshead 153 and to the work head assembly housing 138. When the rams 155 and 156 are actuated, the rams lift or lower the entire framework 150 with respect to the work head housing 138, to lift or lower the spade 154. The spade 154 includes a support plate 158 and a plurality of downwardly protruding teeth 159.

Crosstie push bar 142 is telescopically mounted in work head assembly housing 138 at a position outboard from clamp assembly 140 and shovel assembly 141. Protrusion 161 is connectd to the push bar 142 and extends through slot 162 in the housing, and the arrangement allows the push bar to reciprocate within the housing without falling out from the bottom of the housing.

Tilt ram 164 has its cylinder 165 connected to work head assembly support bracket 136 and its ramrod 166 connected to housing 138. When the ramrod 166 is distended or retracted, the entire workhead assembly housing 138, including clamp assembly 140, shovel assembly 141 and push bar 142 will tilt between a substantially upright attitude and a tilted attitude that corresponds to the end surface **24*a* of housing 24 and the adjacent surface 136*a* of the work head support bracket 136. Thus, the entire assembly is pivotable about pivot pin 135*a* to which the ramrod 135 of power ram 132** is connected.

Figure 5:
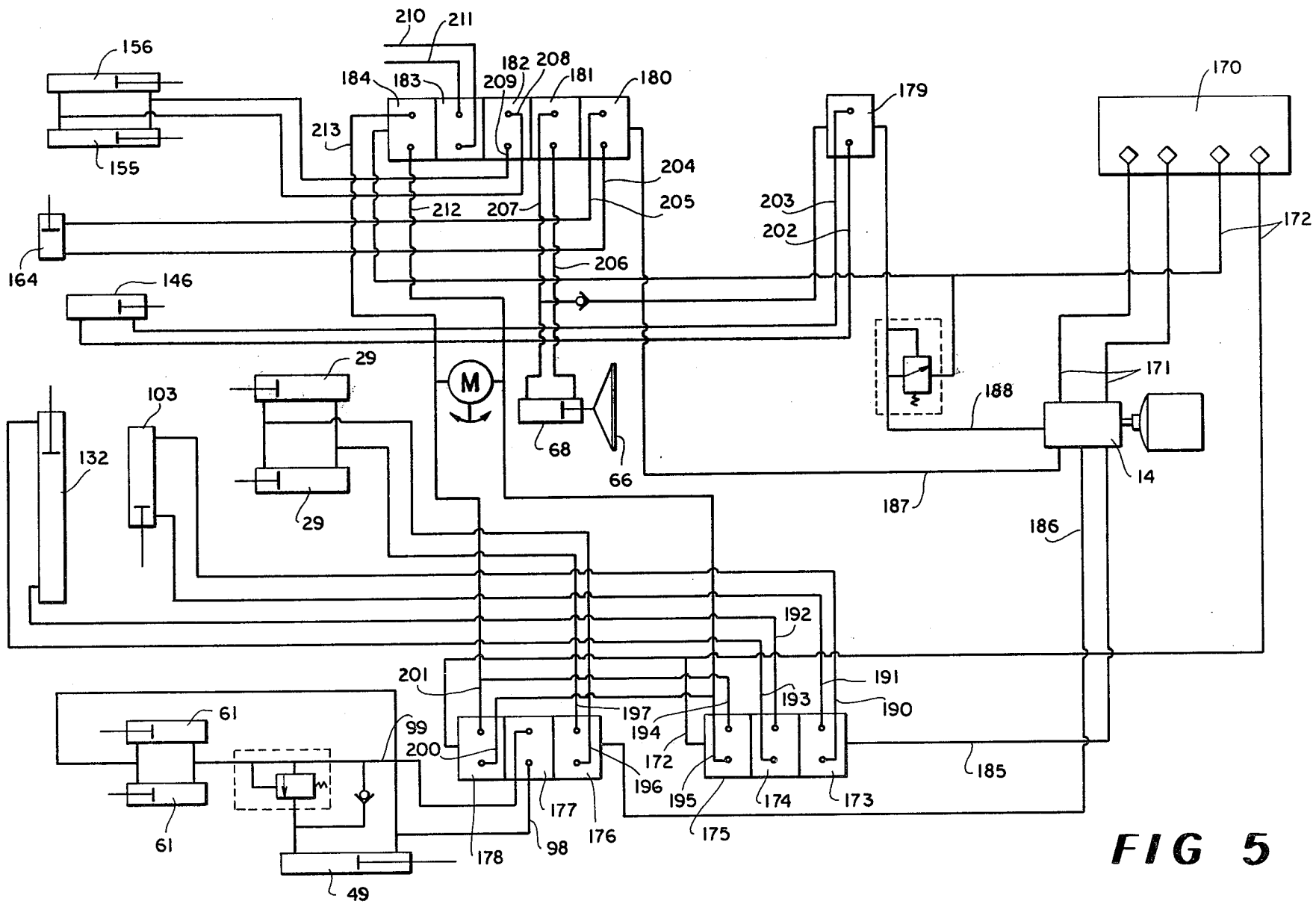
FIG. 5 is a schematic illustration of the hydraulic controls of the crosstie replacement vehicle.

As is illustrated in FIG. 5, hydraulic tank 170 maintains a supply of hydraulic fluid for the pump 14, and supply conduits 171 supply the fluid to the pump while the return conduits 172 return the fluid to the tank from the various operative systems throughout the vehicle. A plurality of solenoid valves 173, 174, 175, 176, 177, 178, 179, 180, 181, 182, 183 and 184 are supplied with liquid under pressure through conduits 185, 186, 187 and 188 from the pump 14. These solenoid valves control the various rams on the vehicle. For example, solenoid valve 173 is a two-position valve which alternately charges either conduit 190 or 191 with liquid to distend or retract double acting kicker ram 103 of crosstie kicker assembly 35. The liquid flowing away from kicker ram 103 comes back through one of the conduits 190 or 191 and flows back to the supply tank 170 through return conduits 172. Solenoid valves 174 and 175 function in a similar manner to charge conduits 192 and 193 and conduits 194 and 195 respectively, to control double acting main ram 132 that distends and retracts the work head assembly 132 from the housing 24, and to operate reversible travel motor M to move the vehicle along the tracks. The remaining solenoid and conduit arrangements are similar in that solenoid valve 176 controls the flow of pressurized liquid to conduits 196 and 197, solenoid valve 177 controls the flow of pressurized liquid to conduits 198 and 199 and solenoid valve 178 controls of pressurized fluid to conduits 200 and 201. With this arrangement, solenoid valve 176 controls the pair of double acting lift rams 29 that raise and lower the pairs of parallel support arms 21 and 22 that control the elevation of housing 24. Solenoid valve 177 controls the double acting rail clamp cylinders 61 on one side of the vehicle and the jack cylinder for the same side of the vehicle, and solenoid valve 178 functions like valve 175 in that it directs fluid to the travel motor M.

The solenoid valves 180, 181, 182, 183 and 184 at the top of FIG. 5 control the flow of pressurized liquid to conduits 202, 203, 204, 205, 206, 207, 208, 209, 210 and 211, 212, and 213. Solenoid valve 179 controls double acting clamp ram 146 which opens and closes the work head clamp, solenoid valve 180 controls double acting tilt ram 164 which tilts the work head assembly, solenoid valve 181 controls the double acting ram 68 of the turntable 66, solenoid valve 182 controls double acting shovel rams 155 and 156, the function of solenoid valve 183 is similar to that of solenoid valve 177 in that it controls the rail dogs and jack on the other side of the vehicle, and solenoid valve 184 functions like valves 175 and 178 to direct fluid to the travel motor M.

OPERATION

As illustrated in FIGS. 6–11, the vehicle 10 travels along the rails 215 and 216 of a railroad track 15. A supply of new crossties 217 are distributed on the rails 215 and 216 at locations adjacent where an old crosstie is to be removed from the railroad track. When the vehicle approaches a new crosstie 217, its push bars 94 (FIG. 1) engage the new crosstie and push the crosstie along the rails until the crosstie is located over an old crosstie that is to be removed from the track. The housing 24 is then lowered so that it tends to rest on the new crosstie. The wedge plates 92 and 93 (FIG. 1) will usually be located on opposite surfaces of the new crosstie, and the inclined surfaces 92*a* of the wedge plates 92 tend to push any other crossties ahead of the crosstie to be inserted further on down the track so as to form clearance between the crosstie under the housing 24 and any crosstie next ahead.

The rail dogs 55 are then lowered by disconnecting their chains 62 from the framework of the vehicle and are positioned with their jaws about the ball of rails 215 and 216. The operator then actuates solenoid valves 177 and 183 which pressurize their rail dog rams 61 and jack rams 49 to lift the forward portion of the vehicle and rails away from the bed of the railroad track.

The operator next actuates the solenoid valve 182 to move the shovel assembly 141 down into contact with the soil at the end of the old crosstie and solenoid valve 174 to reciprocate the work head in and out of its housing 24 as illustrated by arrow 218, whereupon the shovel 141 digs the ballast away from the end of the old crosstie and exposes the end of the old crosstie. When this function has been completed, the shovel 141 is retracted upwardly so that it is out of the way.

The operator then actuates solenoid valve 173 so as to move crosstie kicker assembly 35 in the direction indicatd by arrow 219 (FIG. 8), which kicks or moves the new crosstie 217 to the left toward engagement with push bar 142. This accurately locates the new crosstie 217 so that the crosstie abuts the push bar 141 and is located between the jaws of clamp assembly 140. The crosstie kicker is then retracted and as it approaches its fully-retracted position, its chains 111 and 112 pull the kicker feet 107 and 108 outwardly to their dashed line position (FIG. 1) where the kicker feet are now out of the way.

The operator then actuates solenoid valve 179 to move the clamp jaws together, whereupon the clamp solidly grasps the protruding end of the new crosstie 217, and then actuates solenoid valve 174 that distends the work head assembly and moves the new crosstie 217 further to the left as indicated by arrow 220, until the trailing end 217*a* of the new crosstie clears the exposed end 221*a* of the old crosstie 221. The housing 24 andd therefore the work head assembly 32 are then lowered by actuating solenoid valve 176 until the trailing end 217*a* of the new crosstie 217 is at the level of the exposed end 221*a* of the old crosstie 221. Solenoid valve 174 is then reversed so as to move the work head, including clamp assembly 140 and push bar 142 in the direction indicated by arrow 222, which causes the new crosstie 217 to push against the exposed end of the old crosstie 221 and force the old crosstie out from beneath the rails 215 and 216. When the work head has been fully retracted, the new crosstie 217 will still protrude to some extent out to the side of the railroad track, but the clamping procedure on the end portion of the new crosstie can be repeated to grasp the new crosstie closer to its end portion and then thrust it further beneath its rails and into the space previously occupied by the old crosstie.

In some situations where an obstruction is present beside the railroad track, such as another track or an upwardly extending embankment, tne new crosstie can be inserted by tilting the crosstie downwardly from the work head assembly toward abutment with the exposed end of the old crosstie so that the new crosstie clears the obstruction. In some situations it is desirable to reverse the positions of the crosstie kicker assembly with the work head assembly so that the work head assembly is free of obstructions and one of the cranes 70 can be used to lift the on-coming end of an old crosstie that is being replaced up over an obstruction.

Figure 12:
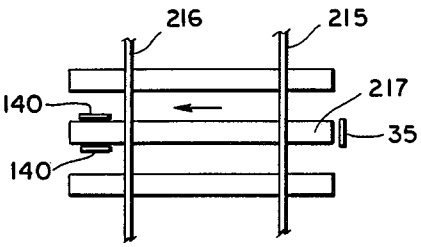
FIGS. 12 and 13 are progressive schematic illustrations of a method of removing a crosstie from a railroad track.
Figure 13:
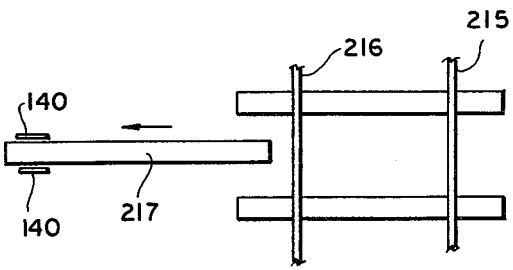
Figure 9:
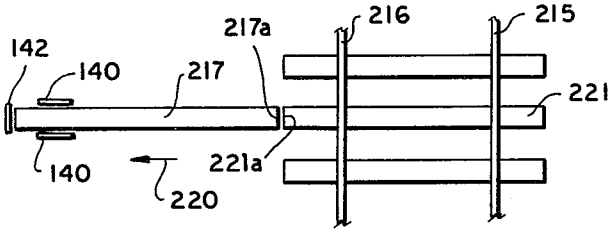
FIGS. 6–11 are progressive schematic illustrations of the procedure for replacing a crosstie in a railroad track.
Figure 10:
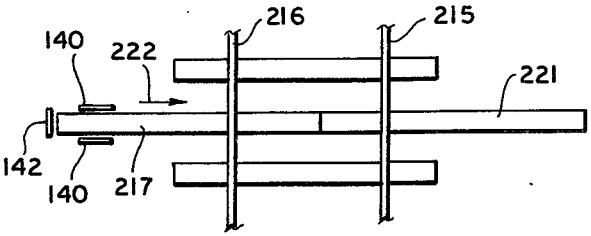
Figure 11:
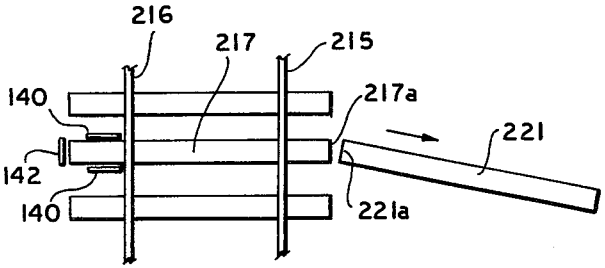
Figure 6:
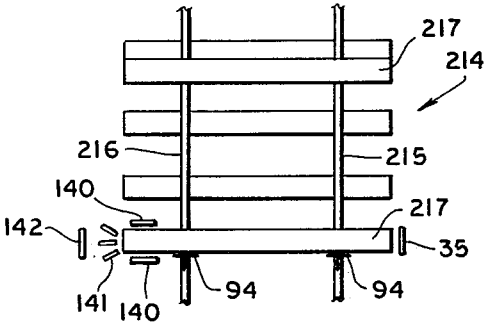
Figure 7:
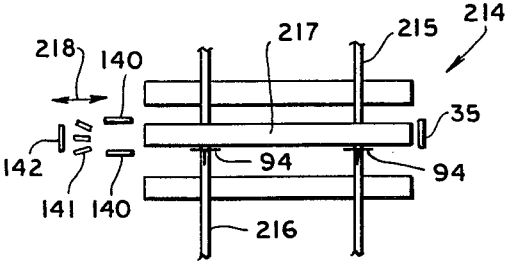
Figure 8:
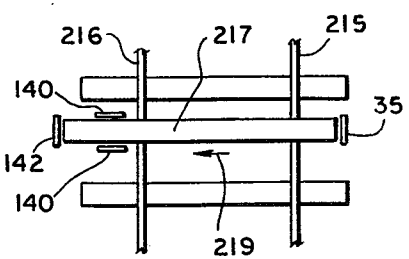

In some situations it is desirable to remove old crossties without using the procedure of butting a new crosstie against the old crosstie. As illustrated in FIGS. 12 and 13, the crosstie kicker 35 is used to push against one end of the old crosstie to "break" the old crosstie from its position in the railroad bed, and the clamp assembly 140 grasps the protruding end of the crosstie and pulls it out from beneath the rails.

While this invention has been described in detail with particular reference to preferred embodiments thereof, it will be understood that variations and modifications can be effected within the spirit and scope of the invention as described hereinbefore and as defined in the appended claims.

I claim:

1. Apparatus for replacing crossties in a railroad track comprising:

a vehicle movable along the rails of a railroad track;

a support housing mounted on one end of said vehicle;

a crosstie kicker assembly supported by said support housing at one side of said vehicle, a work head assembly movably supported by said support housing at the other side of said vehicle, hydraulic power means connected between said support housing and said work head assembly and arranged to apply approximately horizontal forces normal to the railroad track from said support housing to said work head assembly for moving said work head assembly in an approximately horizontal path toward and away from the railroad tracks, hydraulic power means for tilting said work head assembly laterally with respect to the railroad tracks;

hydraulic power means for moving work head assembly vertically with respect to the railroad tracks;

a crosstie clamp assembly attached to said work head assembly, said crosstie clamp assembly comprising a pair of opposed jaw elements arranged for relative spreading and gripping movement in a plane approximately parallel to the rails of the railroad track, and hydraulic power means for actuating said jaw elements, a push bar supported by said work head assembly outboard of said crosstie clamp assembly and movable vertically with respect to said work head assembly to limit the movement of a crosstie between the opposed jaw elements of said crosstie clamp assembly;

a shovel means mounted to said work head assembly between said push bar and said crosstie clamp assembly, said shovel means being vertically movable to a level higher than said clamp assembly whereby said clamp assembly can be operated without interference from said shovel means and to a level lower than said clamp assembly whereby the shovel means reaches lower than the clamp means, and hydraulic power means for moving said shovel means vertically with respect to said work head assembly.

2. Apparatus for replacing crossties in a railroad track comprising a vehicle movable along a railroad track, a tool support housing at one end of said vehicle, tool means supported by said tool support housing at opposite sides of the railroad track, a parallel linkage connected between said vehicle and said tool support housing for guiding said tool support housing through up and down movements with respect to said vehicle, power means for raising and lowering said parallel linkage to raise and lower said tool support housing with respect to the railroad track, bar means supported by and movable with said parallel linkage and including a support member at the end of the parallel linkage, said bar means being movable longitudinally with respect to said parallel linkage to project its support member away from said vehicle, and flexible connector means extending between said support member and said tool support housing whereby the tool support housing can be disconnected from the parallel linkage, the bar means distended with respect to the parallel linkage, the parallel linkage and bar means raised to lift the tool support housing with the flexible connector, and the tool support housing turned end-for-end.

3. Apparatus of claim 2 and further comprising a plurality of fluid conduits communicating between said vehicle and said tool support housing and a boom pivotally connected to said vehicle and extending from said vehicle above said tool support housing, whereby said boom supports said plurality of fluid conduits above said tool support housing and said tool support housing can turn end-for-end beneath said boom and said plurality of fluid conduits.

4. In an apparatus for replacing crossties in railroad tracks including a vehicle moveable along the rails of the railroad track and a support housing carried by said vehicle, the improvement therein of a work head assembly attached to said support housing and comprising:

a pair of opposed jaw elements arranged for relative spreading and gripping movement in a plane approximately parallel to the rails of the railroad track, and hydraulic power means for actuating said jaw elements, a push bar support outboard of said opposed jaw elements and movable in an approximately vertical plane independently of said jaw elements to limit the movement of a crosstie between the opposed jaw elements of said crosstie clamp assembly;

a shovel means mounted between said push bar and said pair of opposed jaw elements, said shovel means being vertically movable alternatively from a level higher than said jaw elements whereby said jaw elements can be operated without interference from said shovel means to a level lower than said clamp assembly whereby the shovel means reaches lower than the clamp means, and hydraulic power means for moving said shovel means in an approximately vertical plane.

* * * * *